US010465687B2

(12) United States Patent
Husted

(10) Patent No.: US 10,465,687 B2
(45) Date of Patent: Nov. 5, 2019

(54) DEVICE FOR CONDITIONING FLOW OF WORKING FLUIDS

(71) Applicant: Howden Roots LLC, Wilmington, DE (US)

(72) Inventor: Dale E. Husted, Centerville, IN (US)

(73) Assignee: HOWDEN ROOTS LLC, Wilmington, DE (US)

( * ) Notice: Subject to any disclaimer, the term of this patent is extended or adjusted under 35 U.S.C. 154(b) by 141 days.

(21) Appl. No.: 15/672,798

(22) Filed: Aug. 9, 2017

(65) Prior Publication Data

US 2018/0023572 A1 Jan. 25, 2018

Related U.S. Application Data

(63) Continuation of application No. PCT/US2016/018934, filed on Feb. 22, 2016.
(Continued)

(51) Int. Cl.
*F04D 29/44* (2006.01)
*F04C 29/12* (2006.01)
(Continued)

(52) U.S. Cl.
CPC ..... *F04C 29/12* (2013.01); *F04C 18/126* (2013.01); *F04C 23/006* (2013.01);
(Continued)

(58) Field of Classification Search
CPC ..... F04C 29/12; F04C 29/0035; F04C 29/06; F04C 23/006; F04C 18/126; F04C 2270/13; F04D 29/444
(Continued)

(56) References Cited

U.S. PATENT DOCUMENTS 5,129,792 A 7/1992 Abousabha
6,056,518 A 5/2000 Allen et al.
(Continued)

FOREIGN PATENT DOCUMENTS

CN 204041494 U 12/2014
DE 112013001631 T5 12/2014
(Continued)

OTHER PUBLICATIONS

Notification of First Office Action with English translation from the State Intellectual Property Office of the People's Republic of China for Application No. 201680011540.7 dated Sep. 21, 2018, 15 pages.
(Continued)

*Primary Examiner* — Hai H Huynh
(74) *Attorney, Agent, or Firm* — Edell, Shapiro & Finnan, LLC

(57) ABSTRACT

The disclosure describes a flow conditioning device for dampening pulses and improving performance of a compressor. In one approach, a diffuser device includes a housing member having a first end and a second end, the housing member coupled to an outlet of a compressor, and a diffuser member disposed within the housing member. The diffuser member is in fluid communication with a working fluid delivered from the compressor, and includes a core member extending along a longitudinal axis of the diffuser member, and a plurality of flutes extending radially from the core member. In some approaches, the plurality of flutes and an inner surface of the housing define a plurality of fluid channels for delivering the working fluid from the first end to the second end of the housing member. In some approaches, the diffuser member is rotatably coupled to the housing member.

20 Claims, 9 Drawing Sheets

Related U.S. Application Data

(60) Provisional application No. 62/119,565, filed on Feb. 23, 2015.

(51) Int. Cl.

| | |
|---|---|
| ***F04C 18/12*** | (2006.01) |
| ***F04C 23/00*** | (2006.01) |
| ***F04C 29/00*** | (2006.01) |
| ***F04C 29/06*** | (2006.01) |

(52) U.S. Cl.
CPC ..... *F04C 29/0035* (2013.01); *F04C 29/06* (2013.01); *F04C 2270/13* (2013.01); *F04D 29/444* (2013.01)

(58) Field of Classification Search
USPC ..... 415/208.2
See application file for complete search history.

(56) References Cited

U.S. PATENT DOCUMENTS

| | | | |
|---|---|---|---|
| 6,547,520 | B2 | 4/2003 | Zinsmeyer et al. |
| 8,596,968 | B2 | 12/2013 | Emmerson |
| 2012/0014788 | A1 | 1/2012 | Blair et al. |
| 2015/0052936 | A1 | 2/2015 | Yokoyama et al. |

FOREIGN PATENT DOCUMENTS

| | | | |
|---|---|---|---|
| JP | S57-121795 | | 1/1982 |
| JP | 3251983 | B2 | 1/2002 |
| JP | 2003278675 | A | 10/2003 |
| JP | 2004150406 | A | 5/2004 |

OTHER PUBLICATIONS

International Preliminary Report on Patentability and Written Opinion for PCT/US2016/018934 dated Aug. 29, 2017.

International Search Report for PCT/US2016/018934 dated Apr. 25, 2016.

Extended European Search Report including supplementary European Search Report and Opinion for PCT/US2016/018934 dated Jun. 28, 2018.

Notice of Reason for Rejection for Japanese Patent Application 2017-562955 dated Oct. 2, 2018.

Notification of Second Office Action with English translation from the China National Intellectual Property Administration for Application No. 201680011540.7 dated Jun. 5, 2019, 18 pages.

DEVICE FOR CONDITIONING FLOW OF WORKING FLUIDS

CROSS-REFERENCE TO RELATED APPLICATIONS

This application is a continuation of International Application No. PCT/2016/018934, filed on Feb. 22, 2016 which claims priority under 35 U.S.C. § 119 to U.S. Provisional Patent Application No. 62/119,565, filed Feb. 23, 2015, entitled "Device for Conditioning Flow of Working Fluids", the entire contents of both of which are hereby incorporated by reference.

FIELD OF THE DISCLOSURE

The subject matter disclosed herein relates generally to compressors and compressor technology and, more specifically, to a device that conditions flow of working fluids at an inlet and/or outlet of a compressor.

BACKGROUND OF THE DISCLOSURE

Compressors are machines that act on a working fluid, for example, to distribute the working fluid under pressure to a process line. Compressors may include rotary compressors, centrifugal compressors, etc. Examples of process lines may be found in various applications including chemical, water-treatment, petro-chemical, resource recovery and delivery, refinery, and like sectors and industries.

Rotary-style compressors include devices that have a housing that forms a chamber with an inlet and an outlet. Inside of the chamber, the devices often have a pair of elements; conventionally these elements embody one or more large lobed-impellers that mesh with one another. In use, the lobed-impellers rotate in opposite directions to displace a known quantity of fluid from the inlet to the outlet. As a pump, the device actively rotates the elements to facilitate movement of the fluid from the inlet to the outlet of the chamber. On the other hand, as a meter, the device is configured for the flow of working fluid to act on the elements. The force of the fluid causes the elements to rotate, which in turn can generate an output (e.g., an electrical signal) that reflects one or more characteristics of the fluid flow.

It is known that use of the lobed-impellers can generate significant pressure and flow pulses during operation of the rotary-style compressor. These flow pulses can resonate downstream and, in turn, induce vibrations of a magnitude that is often significant enough to damage equipment found downstream of the compressor and/or to generate noise at levels that are unsatisfactory even for industrial settings.

Remediation of the problems with flow pulses typically seeks to dissipate energy at the inlet and/or the outlet of the compressor. The solutions often employ noise reduction devices (e.g., silencers) to attenuate sound waves and like perturbations in the working fluid. These devices utilize elements (e.g., baffles) in different arrangements to modify the direction (and other aspects) of the flow of working fluid and, thus, effectively reduce noise and vibrations. Unfortunately, in most conventional implementations, the silencers mount to the exterior of the machinery. This configuration elongates the overall footprint of the machinery, sometimes by as much as 400% or more.

SUMMARY OF THE DISCLOSURE

This disclosure describes embodiments of a flow conditioning device that can dampen pulses and improve performance of a compressor. In one approach, a diffuser device includes a housing member having a first end and a second end, the housing member coupled to an outlet of a compressor, and a diffuser member disposed within the housing member. The diffuser member is in fluid communication with a working fluid delivered from the compressor, and includes a core member extending along a longitudinal axis of the diffuser member, and a plurality of flutes extending radially from the core member. In some approaches, the plurality of flutes and an inner surface of the housing define a plurality of fluid channels for delivering the working fluid from the first end to the second end of the housing member. In some approaches, the diffuser member is rotatably coupled to the housing member.

In one approach, an assembly includes a housing member having a first end and a second end, the housing member coupled to a rotary displacement device. The assembly further includes a diffuser member disposed within the housing member, wherein the diffuser member includes a core member extending along a longitudinal axis of the diffuser member, and a plurality of flutes extending radially from the core member.

In another approach, a compressor assembly includes a compressor and a diffuser device coupled to a compressor, the diffuser device including a housing member having a first end and a second end, wherein the housing member is coupled to an outlet of the compressor for receiving a working fluid. The diffuser device further includes a diffuser member disposed within the housing member, the diffuser member including a core member extending along a central longitudinal axis of the diffuser member and a plurality of flutes extending radially from the core member.

In yet another embodiment, a diffuser device includes a housing member having a first end and a second end, the housing member coupled to an outlet of a compressor, and a diffuser member disposed within the housing member. The diffuser member is in fluid communication with a working fluid delivered from the compressor, and includes a core member extending along a longitudinal axis of the diffuser member, and a plurality of flutes extending radially from the core member.

BRIEF DESCRIPTION OF THE DRAWINGS

By way of example, specific embodiments of the disclosed device will now be described, with reference to the accompanying drawings, in which.

Figure 1:
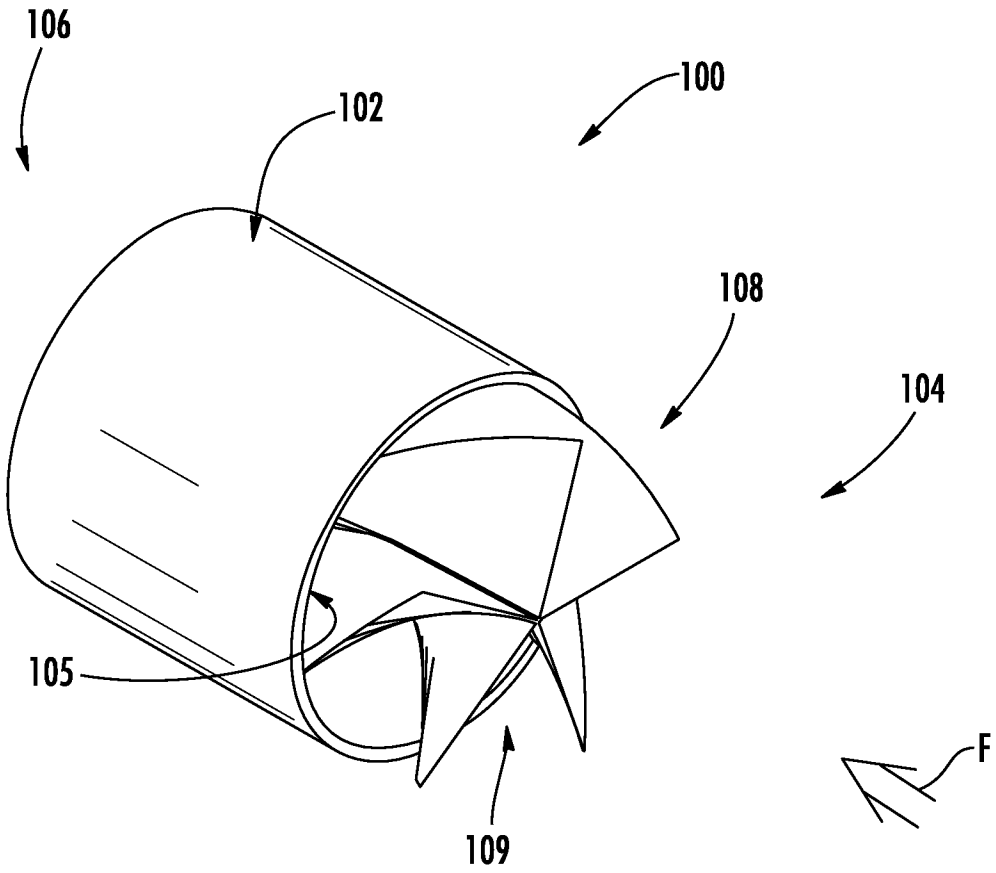
FIG. 1 depicts a perspective view of an exemplary flow conditioning device according to embodiments of the present disclosure.

Where applicable like reference characters designate identical or corresponding components and units throughout the several views, which are not to scale unless otherwise indicated. Moreover, the embodiments disclosed herein may include elements that appear in one or more of the several views or in combinations of the several views.

DETAILED DESCRIPTION

The present disclosure will now proceed with reference to the accompanying drawings, in which various approaches are shown. It will be appreciated, however, that the disclosure may be embodied in many different forms and should not be construed as limited to the approaches set forth herein. Rather, these approaches are provided so that this disclosure will be thorough and complete, and will fully convey the scope of the disclosure to those skilled in the art. In the drawings, like numbers refer to like elements throughout.

As used herein, an element or operation recited in the singular and proceeded with the word "a" or "an" should be understood as not excluding plural elements or operations, unless such exclusion is explicitly recited. Furthermore, references to "one approach" or "one embodiment" of the present disclosure are not intended to be interpreted as excluding the existence of additional approaches or embodiments that also incorporate the recited features.

Furthermore, spatially relative terms, such as "beneath," "below," "lower," "central," "above," "upper," "on," "over," and the like, may be used herein for ease of describing one element's relationship to another element(s) as illustrated in the figures. It will be understood that the spatially relative terms may encompass different orientations of the device in use or operation in addition to the orientation depicted in the figures.

As stated above, described herein is a compressor assembly including a compressor and a diffuser device coupled to a compressor, the diffuser device including a housing member having a first end and a second end. The housing member is coupled to an outlet of the compressor for receiving a working fluid. The diffuser device further includes a diffuser member disposed within the housing member, the diffuser member having a core member extending along a central longitudinal axis of the diffuser member and a plurality of flutes extending radially from the core member. In some approaches, the diffuser member may rotate relative to the housing member, thereby reducing pressure pulsation and resulting in a flat signal, namely, a discharge pressure with little or no fluctuation.

As will be described in greater detail below, the flutes of the diffuser member define a plurality of fluid channels having a swirl or helical configuration, which has the benefit of improving discharge pressure and decreasing discharge pressure pulsation. By reducing discharge pressure pulsation, the need for a discharge silencer at the compressor outlet may be reduced or eliminated. In some approaches, the diffuser device may be installed on new rotary compressors, or as a retrofit for legacy compressors currently in the field. In the case of existing legacy units, the discharge piping may be modified, for example, by installing a new spool piece containing the diffuser device therein.

Figure 2:
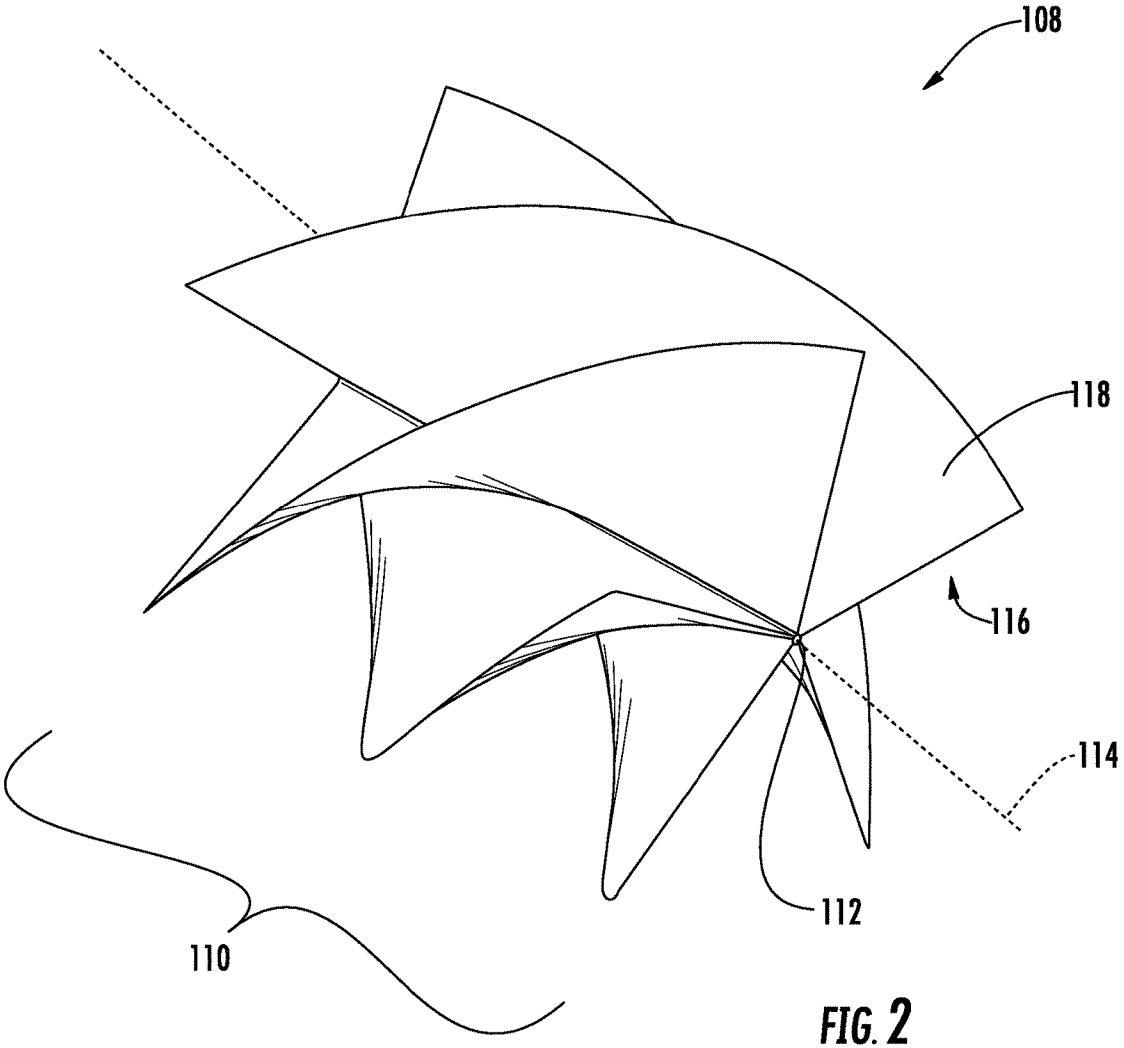
FIG. 2 depicts a perspective view of the flow conditioning device of FIG. 1 according to embodiments of the present disclosure.
Figure 3:
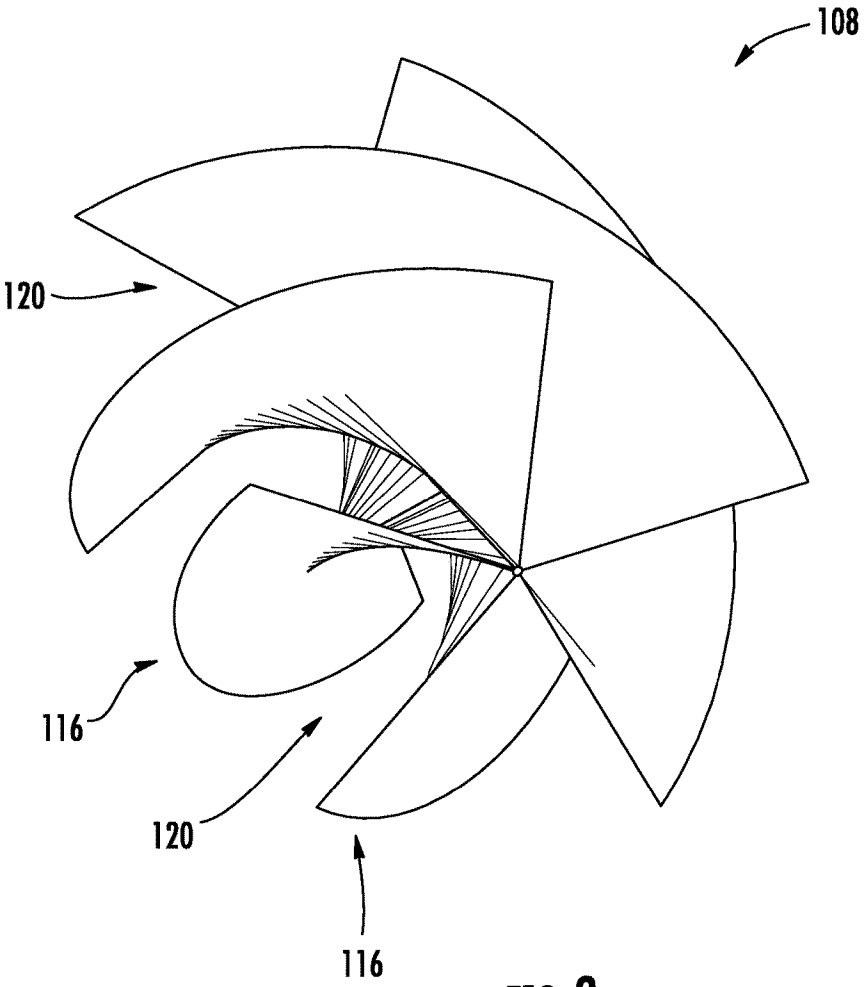
FIG. 3 depicts a perspective view of the flow conditioning device of FIG. 1 according to embodiments of the present disclosure.

Turning now to FIGS. 1, 2 and 3, an exemplary diffuser device will be described in greater detail. As shown, embodiments herein include of a flow conditioning diffuser device 100 (hereinafter "device 100") for use with a compressor, for example. FIG. 1 depicts a perspective view of the device 100. FIGS. 2 and 3 depict perspective views of the device 100 in exploded form.

In FIG. 1, the device 100 includes a housing member 102 with a first end 104 (also "upstream end 104") and a second end 106 (also "downstream end 106"). The housing member 102 at least partially encloses a diffuser member 108. That is, a portion 109 of the diffuser member extends out of the housing member 102, beyond the first end 104. The ends 104, 106 of the device 100 may be configured to couple with a compressor and/or with ancillary piping and/or conduits, as will be described in greater detail below. The housing 102 may include, for example, a flange and/or like element for mating with a corresponding flange on the compressor (and/or ancillary piping). This configuration directs a working fluid F (e.g., gas and liquid) into the device 100 to impinge on the diffuser member 108.

With reference also to FIGS. 2 and 3, the diffuser member 108 has a body 110 that includes a core member 112 with a longitudinal axis 114. The body 110 also has a plurality of flutes 116 (alternatively known as blades, fins, or vanes) disposed circumferentially about the longitudinal axis 114. Each of the flutes 116 has a flute body 118 that may extend the length of the longitudinal axis 114. The flutes 114 are spaced radially apart from one another so that a pair of the flutes 114, together with an inner surface 105 of the housing member 102 (FIG. 1), forms the boundaries of several fluid channels or flow paths 120. In this configuration, the geometry of the flow paths 120 depends, effectively, on the profile (and/or geometry) of the flute body 114. In one embodiment, the flow paths 120 extend helically around the core member 112.

As configured, the diffuser member 108 is in fluid communication with the working fluid F, which passes through the flow path 120. The swirl/helical profile is configured to condition the flow of the working fluid F from, for example, a first flow pattern at the upstream end 104 to a second flow pattern at the downstream end 106. In one implementation, the profile of the flute body 118 is configured to cause the working fluid F to exit the flow paths 120 as a swirling flow and/or in a swirl pattern due to the helical shape of the flutes 116.

By inducing the working fluid F into a swirl shaped flow pattern, a higher discharge pressure may be achieved. This phenomenon may be evidenced, for example, with centrifugal rolled over volutes, wherein the estimated performed improvement for a 400Hp centrifugal test rig between a standard symmetric volute in which the gas is dumping into the volute collector and a rolled over volute was 1 point of efficiency and approximately 4.5% improvement in pressure coefficient. The improved diffusion through the housing 102 due to the shape/configuration of the flute body 118 will ultimately result in better mixing out of the discharge flow, thus reducing the discharge pressure pulsation.

In some constructions, the diffuser member 108 is fixed within the housing 102 and remains stationary against the flow of the working fluid F. In other implementations, the diffuser member 108 may be rotatably coupled with the housing 102, thus allowing rotation around the core 112 with respect to the housing 102, whether passively and/or actively (e.g., by way of a collateral motor or other motive element). For either stationary or rotatable configurations, the device 100 may include one or more structural components (e.g., bearings, struts, etc.) for coupling the diffuser member 108 to the housing member 102 and or the compressor, while avoid interference with the flow of working fluid F through the device 100.

Figure 4:
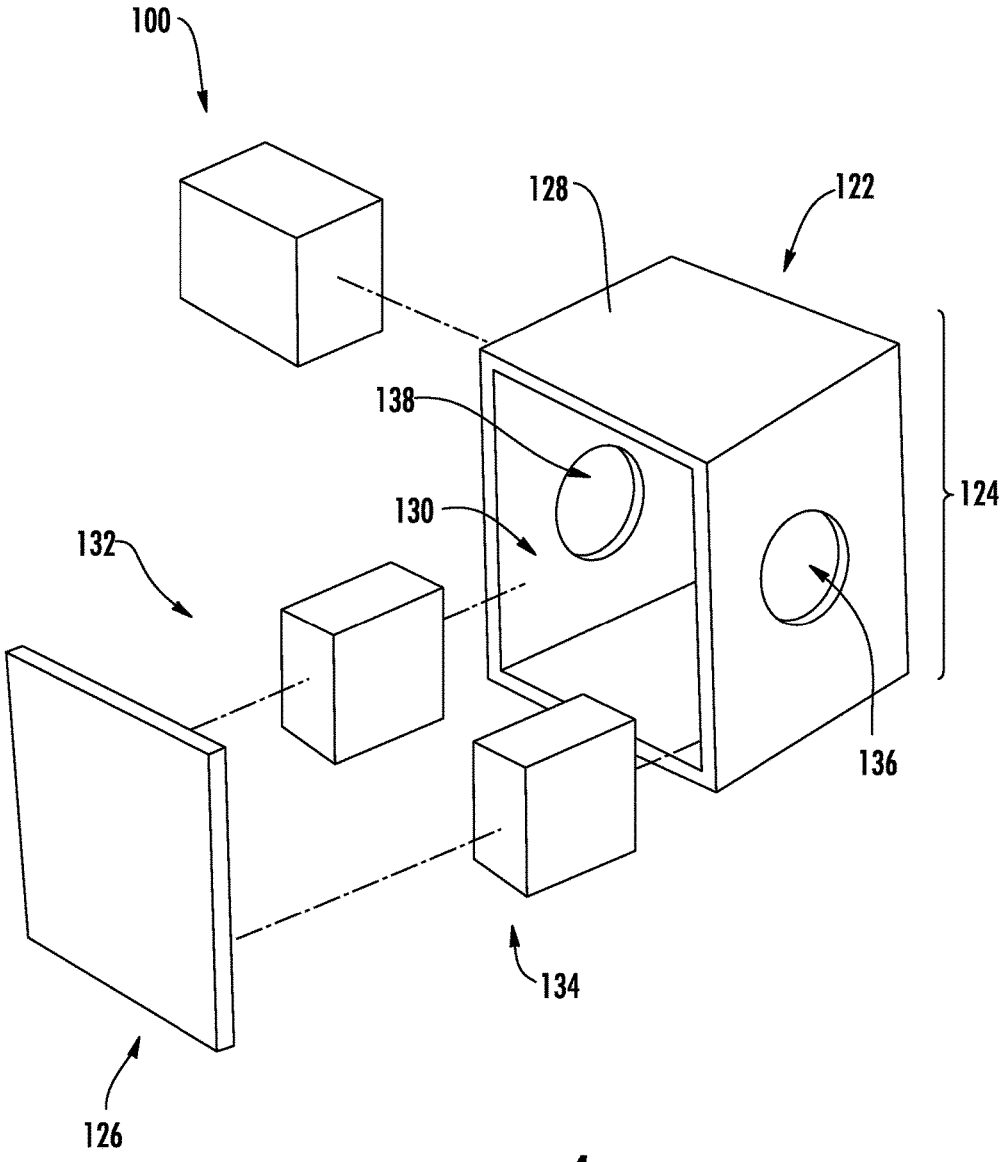
FIG. 4 depicts one implementation for an exemplary embodiment of a flow conditioning device on a rotary displacement device according to embodiments of the present disclosure.

FIG. 4 depicts, schematically, one implementation of the device 100 in connection with a rotary displacement device 122. Examples of the rotary displacement device 122 include pumps and meters that accommodate the working fluid F. The rotary displacement device 122 includes a housing 124 and a cover 126. The housing 124 has a peripheral wall 128 that forms an inner volume 130. When the displacement device 122 is assembled, the housing 124 and the cover 126 couple together to enclose rotating elements 132, 134 in the inner volume 130. This configuration also seals the inner volume 130 to prevent leaks of the working fluid F therefrom.

As shown in FIG. 4, one or more openings (e.g., a first opening 136 and a second opening 138) penetrate through the peripheral wall 128. The openings 136, 138 allow ingress and egress into the inner volume 130 from outside of the housing 124. In one example, the openings 136, 138 include an inlet and an outlet (or discharge) that allow the working fluid F to flow into the inner volume 130 (e.g., via the inlet) and to flow out of the inner volume 130 (e.g., via the outlet). The device 100 may be coupled to the peripheral wall 128, around the opening 138, to receive the discharged working fluid F therefrom.

The rotary displacement device 122 may facilitate movement of the working fluid F and/or measure movement of the working fluid F that flows in the inner volume 130, as desired. In one implementation, for example, the rotary displacement device 122 can operate as a pump and/or blower to draw fluid into the inner volume 130 and expel fluid from the inner volume 124 via the inlet and the outlet, respectively. In another implementation, the rotary displacement device 122 can operate as a meter and/or measurement device, which monitors flow characteristics (e.g., flow rate) of fluid that flows from the inlet to the outlet.

Figure 5:
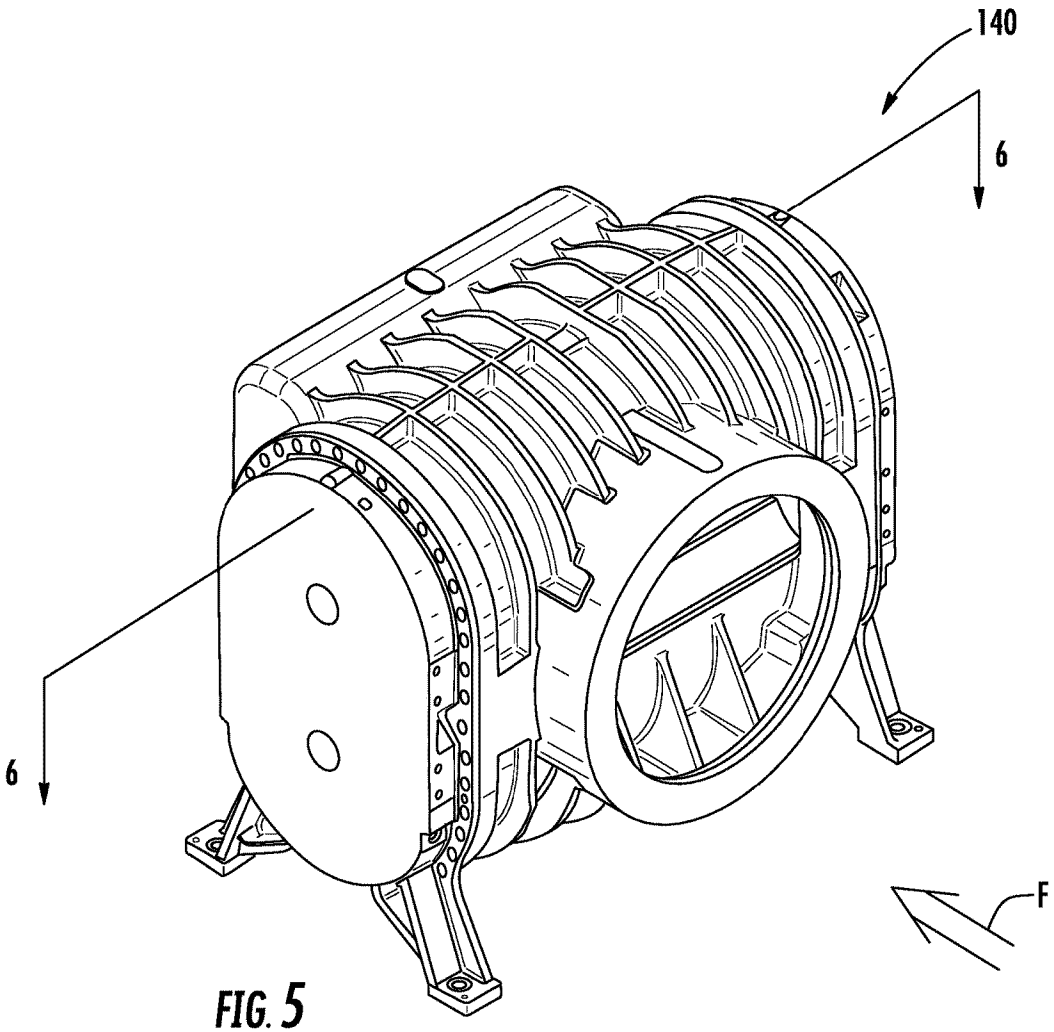
FIG. 5 depicts a perspective view of a rotary-style compressor according to embodiments of the present disclosure.
Figure 6:
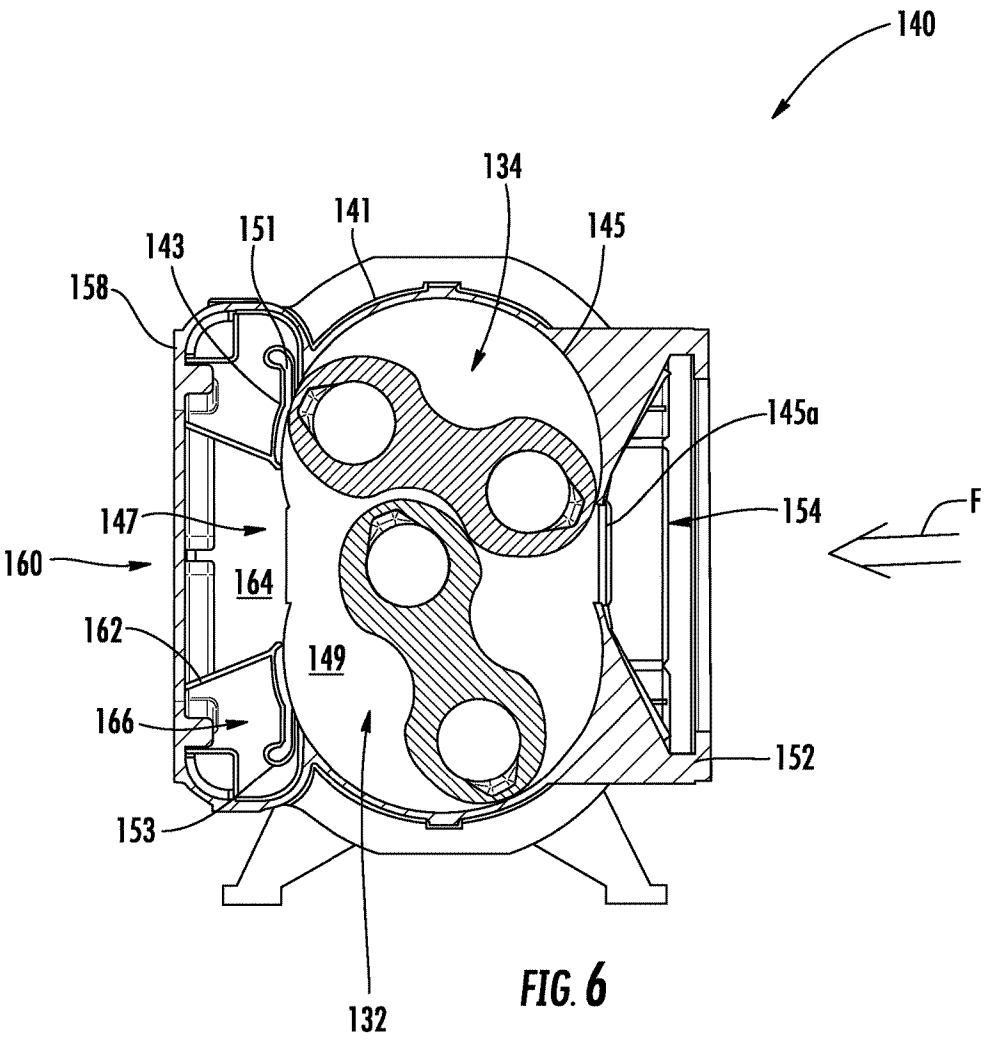
FIG. 6 depicts a cross-section of the rotary-style compressor of FIG. 5 according to embodiments of the present disclosure.

FIGS. 5 and 6 respectively depict perspective and cross-sectional views of an example of the rotary displacement device 122 in the form of a rotary-style compressor 140. In one non-limiting embodiment, as shown in FIG. 6, the compressor 140 includes a housing 141 having two curved opposed walls 143 and 145 having an inlet opening 145*a* and a discharge opening 147 extending therethrough. The openings 145*a* and 147 communicate with a chamber 149.

Rotating elements 132, 134 are mounted on shafts (not shown) for rotation with the chamber 149. In some embodiments, the rotating elements 132, 134 each have a general "figure 8" shape. As such, the rotating elements 132, 134 are angularly positioned on their respective shafts so that the end portions of each impeller "nest" in the necked down portion of the other impeller, for example as shown.

A plurality of angularly-spaced jet passages, two of which are referred to by the reference numeral 151, are formed in the wall 143 in an radially outwardly-spaced relation to the discharge opening 147. The passages 151 are defined in part by an annular extension, or flange 153 that extends from the wall 143 and is provided with an enlarged, rounded outer portion. The flange 153 functions to direct a portion of the working fluid (e.g., air) through the jet passages 151 and back to the chamber 149.

An inlet plenum 152 extends from the wall 145 and has an inlet opening 154 for receiving the working fluid F, a discharge plenum 158 extending from the wall 143, and a discharge opening 160 for discharging the working fluid F. It is understood that at least one motor (not shown) may be provided in the housing 141 for driving the shafts in an opposite direction. As further shown, the compressor 140 includes a frusto-conical partition 162 (hereinafter partition 162) provided in the discharge plenum 158, the partition 162 defining a discharge chamber 164 in the center of the discharge plenum 158, and an annular recirculation chamber 166 surrounding the discharge chamber 164.

Figure 7:
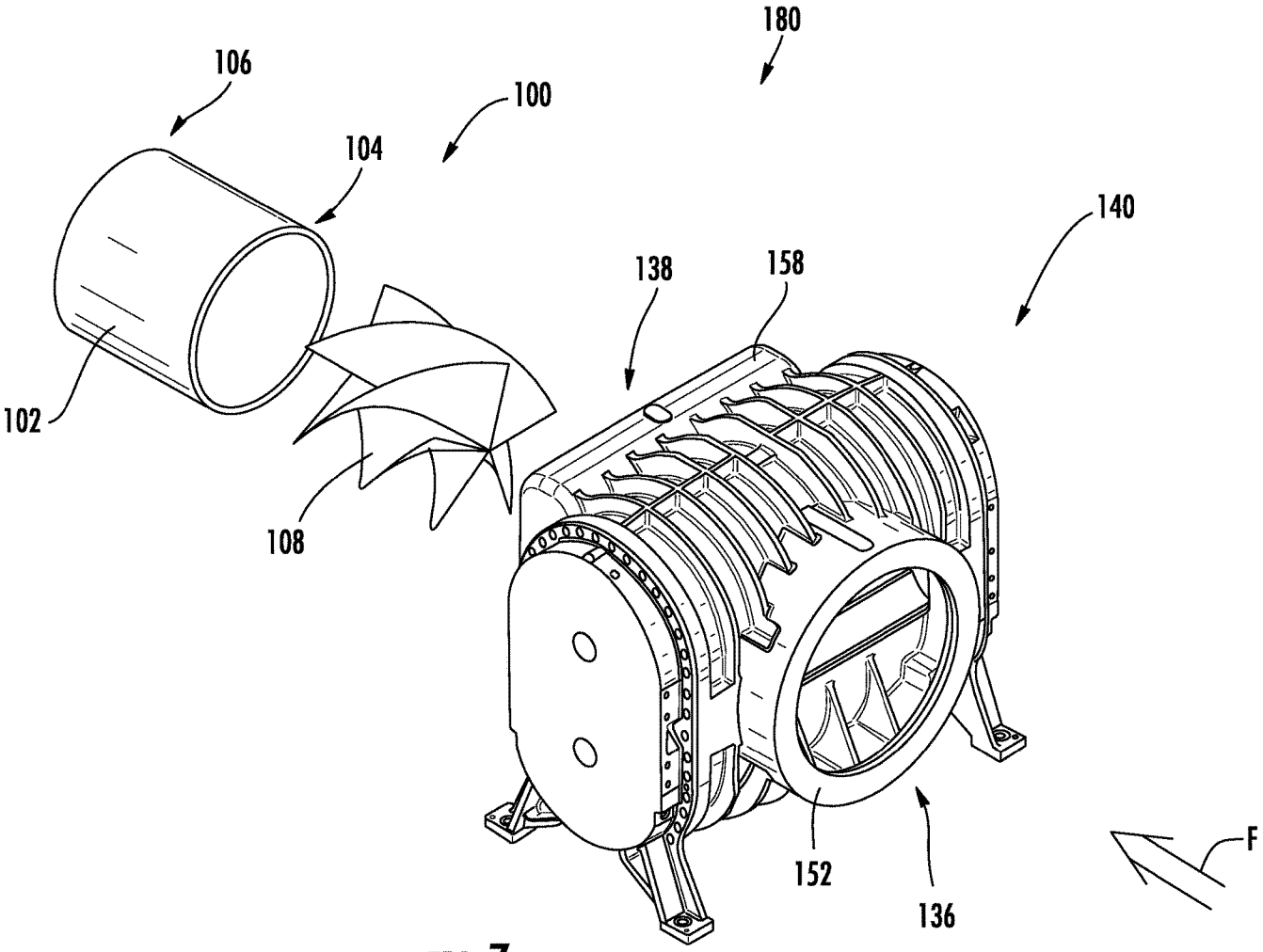
FIG. 7 depicts one implementation for an exemplary embodiment of a flow conditioning device on the rotary-style compressor of FIGS. 5 and 6 according to embodiments of the present disclosure.
Figure 8:
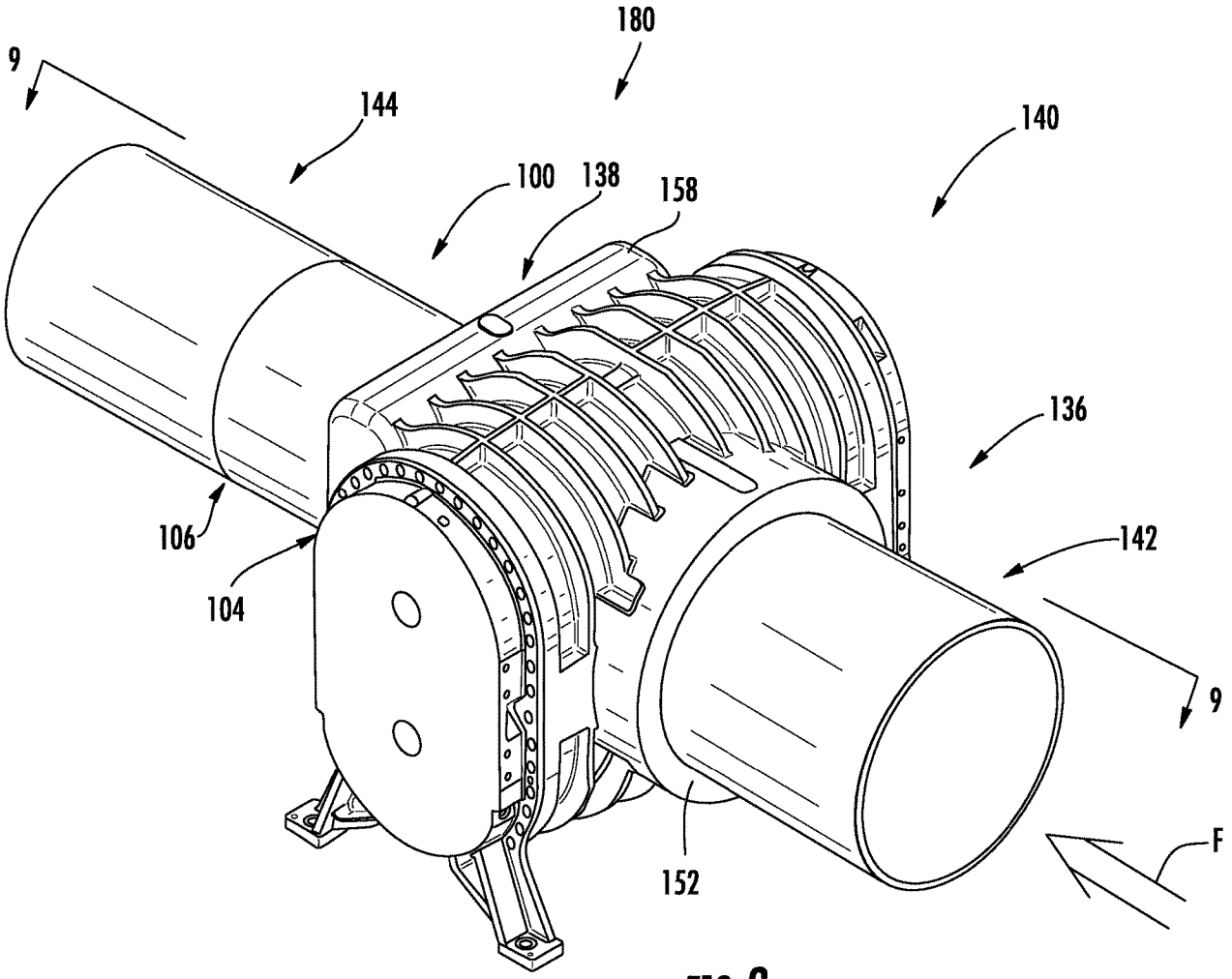
FIG. 8 depicts one implementation for an exemplary embodiment of a flow conditioning device on the rotary-style compressor of FIGS. 5, 6, and 7 according to embodiments of the present disclosure.

Turning now to FIGS. 7 and 8 depicted are perspective views of a compressor assembly 180 according to embodiments of the present disclosure. As shown, the compressor assembly 180 includes the device 100 coupled to the rotary-style compressor 140. More specifically, the first end 104 of the housing member 102 is coupled to the discharge plenum 158 of the compressor 140 at the outlet 138 for receiving the working fluid F therefrom.

In one embodiment, as shown in FIG. 8, the compressor assembly 180 includes a pair of ancillary pipes or conduits (e.g., a first conduit 142 and a second conduit 144). For example, the first conduit 142 couples to the inlet plenum 152 at the inlet 136 to facilitate flow of the working fluid F to the compressor 140. Meanwhile, the second conduit 144 couples to the second end 106 of the device 100, which in turn couples with the discharge plenum 158 at the outlet 138 of the compressor 140.

Figure 9:
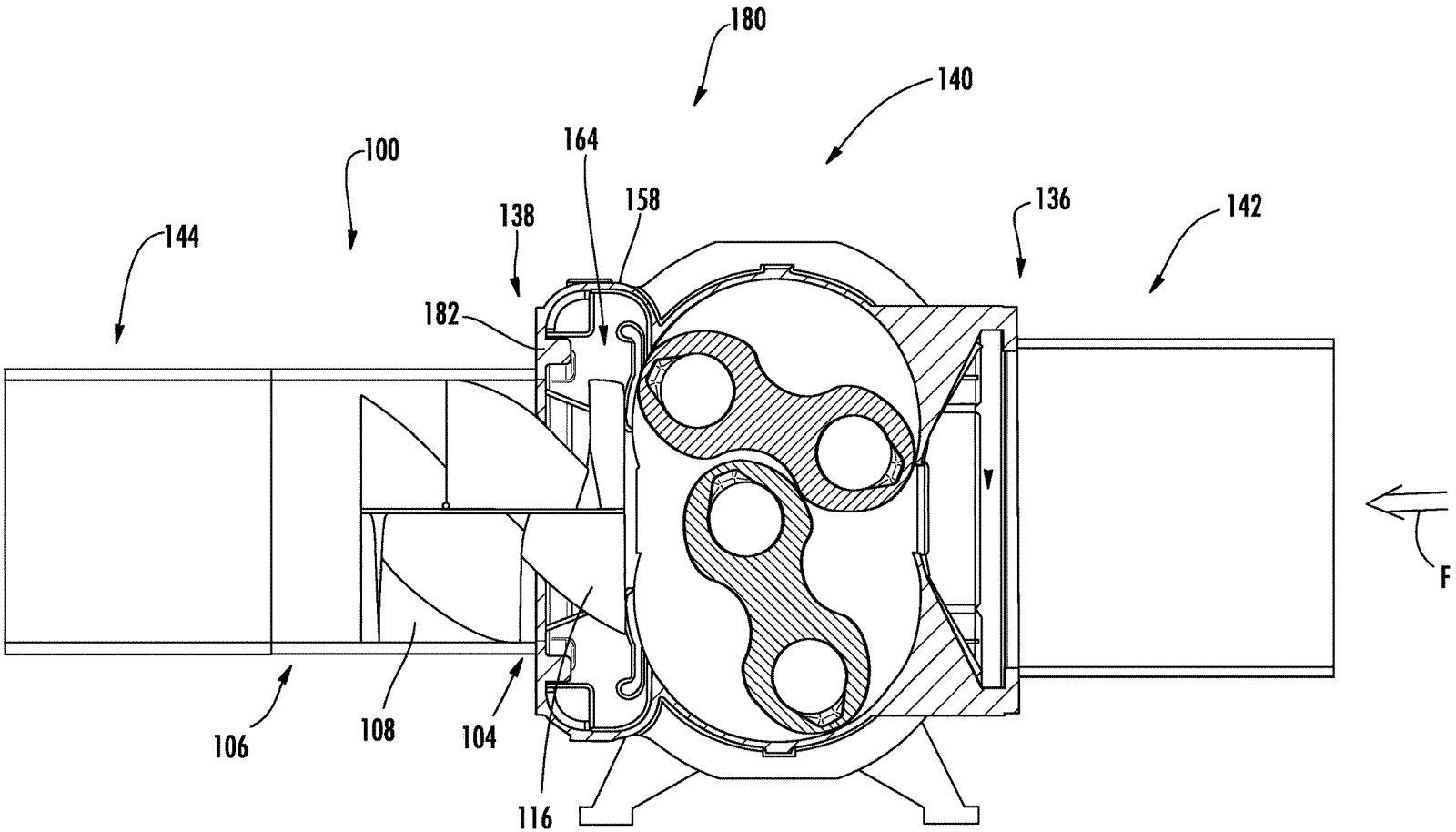
FIG. 9 depicts a cross-section of the rotary-style compressor in FIG. 8 according to embodiments of the present disclosure.

FIG. 9 depicts a cross-section of the compressor assembly 180 of FIG. 8 taken at line 9-9. In this example, the diffuser member 108 can be seen extending at least partially into the compressor 140. Specifically, one or more of the flutes 116 extend into the discharge plenum 158, as shown. In the case where the diffuser member 108 rotates with respect to the housing member 102, the flutes 116 are allowed to rotate within the discharge chamber 164. In some embodiments, the first end 104 of the housing member 102 is secured to a downstream sidewall 182 of the discharge plenum 158 by any variety of fasteners (not shown).

As used herein, an element or function recited in the singular and proceeded with the word "a" or "an" should be understood as not excluding plural said elements or functions, unless such exclusion is explicitly recited. Furthermore, references to "one embodiment" of the claimed invention should not be interpreted as excluding the existence of additional embodiments that also incorporate the recited features.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural element

What is claimed is:

1. An assembly comprising:

a housing member having a first end and a second end, the housing member coupled to a rotary displacement device such that the housing member is external to the rotary displacement device; and a diffuser member disposed within the housing member, the diffuser member including:

a core member extending along a longitudinal axis of the diffuser member; and a plurality of flutes extending radially from the core member.

2. The assembly of claim 1, wherein each of the plurality of flutes includes a flute body extending along a length of the longitudinal axis.

3. The assembly of claim 1, wherein the rotary displacement device is a compressor.

4. The assembly of claim 3, wherein the first end of the housing member is coupled to the compressor to receive a working fluid from the compressor.

5. The assembly of claim 4, the compressor comprising:

an inlet for receiving the working fluid; and an outlet for delivering the working fluid to the housing member, the outlet including an outlet housing containing a portion of the diffuser member extending beyond the first end of the housing member.

6. The assembly of claim 5, further comprising a first conduit coupled to the inlet of the compressor and a second conduit coupled to the second end of the housing member.

7. The assembly of claim 1, wherein the diffuser member is rotatably coupled to the housing member.

8. The assembly of claim 1, the plurality of flutes and an inner surface of the housing member defining a plurality of fluid channels.

9. The assembly of claim 8, the plurality of fluid channels extending helically around the core member.

10. A compressor assembly comprising:

a compressor; and a diffuser device coupled to the compressor, the diffuser device comprising:

a housing member having a first end and a second end, the housing member coupled to an outlet of the compressor such that the housing member is external to the compressor and receives a working fluid from the outlet of the compressor; and a diffuser member disposed within the housing member, the diffuser member including a core member extending along a central longitudinal axis of the diffuser member and a plurality of flutes extending radially from the core member.

11. The compressor assembly of claim 10, wherein each of the plurality of flutes includes a flute body extending along a length of the central longitudinal axis.

12. The compressor assembly of claim 10, wherein a portion of the diffuser member extends beyond the first end of the housing member.

13. The compressor assembly of claim 12, the compressor comprising an outlet housing surrounding the portion of the diffuser member.

14. The compressor assembly of claim 10, further comprising a first conduit coupled to an inlet of the compressor and a second conduit coupled to the second end of the housing member.

15. The compressor assembly of claim 10, wherein the diffuser member is rotatably coupled to the housing member.

16. The compressor assembly of claim 10, the plurality of flutes and an inner surface of the housing member defining a plurality of fluid channels.

17. The compressor assembly of claim 16, the plurality of fluid channels extending helically around the core member.

18. A diffuser device comprising:

a housing member having a first end and a second end, the housing member coupled to an outlet of a compressor such that the housing member is external to the compressor; and a diffuser member disposed within the housing member, wherein the diffuser member is in fluid communication with a working fluid delivered from the compressor, and wherein the diffuser member comprises:

a core member extending along a longitudinal axis of the diffuser member; and a plurality of flutes extending radially from the core member.

19. The diffuser device of claim 18, wherein each of the plurality of flutes includes a flute body extending along a length of the diffuser member in a swirl configuration.

20. The diffuser device of claim 18, the plurality of flutes and an inner surface of the housing member defining a plurality of fluid channels.

* * * * *